US010018336B2

(12) United States Patent
Germain et al.

(10) Patent No.: US 10,018,336 B2
(45) Date of Patent: Jul. 10, 2018

(54) ENGAGEMENT MECHANISM AND METHOD FOR MOUNTING LIGHTING FIXTURE

(71) Applicant: GE Lighting Solutions, LLC, East Cleveland, OH (US)

(72) Inventors: Steve Germain, L'lle-Perrot (CA); John Edward Chancey, East Cleveland, OH (US)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 309 days.

(21) Appl. No.: 14/882,615

(22) Filed: Oct. 14, 2015

(65) Prior Publication Data

US 2017/0009963 A1 Jan. 12, 2017

Related U.S. Application Data

(60) Provisional application No. 62/189,411, filed on Jul. 7, 2015.

(51) Int. Cl.
*F21V 21/04* (2006.01)

(52) U.S. Cl.
CPC ..... *F21V 21/04* (2013.01); *F21V 21/042* (2013.01); *F21V 21/044* (2013.01); *F21V 21/045* (2013.01); *F21V 21/046* (2013.01)

(58) Field of Classification Search
CPC ..... F21V 21/04; F21V 21/042; F21V 21/044; F21V 21/045; F21V 21/046
See application file for complete search history.

(56) References Cited

U.S. PATENT DOCUMENTS

| | | | | |
|---|---|---|---|---|
| 5,410,782 | A | 5/1995 | Holyoake | |
| 2011/0180678 | A1 | 7/2011 | Liu | |
| 2015/0330611 | A1* | 11/2015 | Abai | F21V 21/03 362/418 |

FOREIGN PATENT DOCUMENTS

| | | | |
|---|---|---|---|
| AU | 676534 | B2 | 3/1997 |
| DE | 20 2010 000 066 | U1 | 4/2010 |
| DE | 20 2015 101 742 | U1 | 5/2015 |
| FR | 2 978 509 | A1 | 2/2013 |
| WO | 2015/058707 | A1 | 4/2015 |

OTHER PUBLICATIONS

International Search Report and Written Opinion issued in connection with corresponding PCT Application No. PCT/US2016/040938 dated Nov. 3, 2016.
http://www.youtube.com/watch?v=Tob89ByGhL4.

* cited by examiner

*Primary Examiner* — Mary Ellen Bowman
(74) *Attorney, Agent, or Firm* — Peter T. DiMauro; GE Global Patent Operation

(57) ABSTRACT

Provided is a device configured for attachment to a lighting fixture. The device includes an engagement mechanism that allows the lighting fixture to be mounted within a recess of a substantially flat surface. The engagement mechanism is constructed to facilitate movement of a tension mechanism from a maximum tension position to a minimum tension position. Movement of the engagement mechanism is in response to an applied force generated by contact of the engagement mechanism with a first side of the substantially flat surface. Also provided is a method for mounting the lighting fixture using the engagement mechanism.

14 Claims, 5 Drawing Sheets

ENGAGEMENT MECHANISM AND METHOD FOR MOUNTING LIGHTING FIXTURE

I. FIELD OF THE INVENTION

The present invention is related to installation of lighting fixtures. More specifically, the present invention relates to mechanisms for mounting lighting fixtures in locations, such as a ceiling.

II. BACKGROUND OF THE INVENTION

Luminaires are increasingly relied upon for white light production in downlight high-ceiling applications. These applications provide lighting for offices, retail space settings, and other commercial applications. Additionally, more recently developed downlight luminaires also include advanced lighting technology that is inherently more sustainable, while providing significant energy savings than predecessor, or legacy systems.

High-ceiling luminaire applications, however, are generally associated with inherent maintenance inefficiencies. For example, in addition to costs associated with lamp replacement, lifts and scaffolding are usually required to safely perform installation and maintenance for high-ceiling luminaires. These installation and maintenance challenges are further complicated because many of these luminaires are recessed and simply difficult to install or remove.

To assist the installation process, many conventional downlight luminaires include sheet-metal fixing springs on opposing sides of the luminaire for recessed installations through recesses/carveouts in the ceiling. In conventional approaches, an installer pushes the lighting in one direction into the opening of the ceiling and then pulls the lighting fixture in another (e.g., opposite) direction to lock the luminaire into place. During installation, as one example, installers must use their fingers to hold the springs under tension, while inserting the luminaire through the recess.

Many conventional downlights provide two springs and expect installers to use their hands to position them appropriately for installation. However, installation of downlights using springs can pose a risk of injury to the installers' fingers, hand, or other body parts. Additionally, it is difficult for installers to position, hold, and release more than two springs at the same time during installation in an upward vertical position. Furthermore, the use of only two tension mechanisms may not support the weight of heavier downlight fixtures, causing these fixtures to sag or tilt after installation.

III. SUMMARY OF THE EMBODIMENTS

Given the aforementioned deficiencies, a need exists for mounting systems and methods to facilitate improve the ease of installation of luminaires, and other recessed fixtures, into a ceiling, wall, or other substantially flat surface.

Embodiments of the present invention include a device configured for attachment to a lighting fixture including an engagement mechanism that allows the lighting fixture to be mounted within a recess of a substantially flat surface. The engagement mechanism is constructed to facilitate movement of a tension mechanism from a maximum tension position to a minimum tension position. In the embodiments, the tension mechanism can include a spring clamp. Movement of the engagement mechanism is in response to an applied force generated by contact of the engagement mechanism with a first side of the substantially flat surface. As a result, the lighting fixture is mounted within the recess such that the tension mechanism is in contact with the second side.

In some embodiments, the substantially flat surface includes a ceiling or a wall. In particular embodiments, the recess is a carveout area in the ceiling.

In some embodiments, the engagement mechanism is a lever retainer configured to release the tension mechanism upon contact with the first side.

In other embodiments, the engagement mechanism is affixed to a bracket configured for attachment to the lighting fixture having a tension mechanism configured for rotatable movement in response to the applied force a substantially flat surface. In these embodiments, the bracket includes a flange configured to retain and support at least a portion of the tension mechanism while in the maximum tension position. The flange releases the tension mechanism causing the lever retainer to come in contact with first side of the substantially flat surface.

In some embodiments, the engagement mechanism is a sheet retainer configured to release the tension mechanism upon contact with the first side. The sheet retainer includes a lance configured to support at least a portion of the tension mechanism while in the maximum tension position. The lance releases the tension mechanism when the sheet retainer comes in contact with the first side. The material of the sheet retainer is at flexible, having the ability to deform from and return to an original position.

An advantage of the embodiments is providing for easy mounting of lighting fixtures because an installer does not need to hold tension mechanisms (e.g., clamp springs) during the installation. The tension mechanisms automatically release when the engagement mechanism comes in contact with the flat surface (e.g., ceiling), thus avoiding risk of injury to hands and fingers of the installer.

Another advantage enabling multiple tension mechanisms to be mounted on one lighting fixture. Multiple tension mechanisms allow use of the engagement mechanisms on larger and heavier downlight fixtures. Additionally, multiple tension mechanisms do not complicate installation, as the tension mechanisms automatically release upon contact with the flat surface.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

IV. BRIEF DESCRIPTION OF THE DRAWINGS

To provide a thorough understanding of the present disclosure, embodiments of the present invention are described below with reference to the accompanying drawings, wherein.

V. DETAILED DESCRIPTION

While illustrative embodiments are described herein with illustrative embodiments for particular implementations, it should be understood that the invention is not limited thereto. Those skilled in the art with access to the teachings provided herein will recognize additional modifications, applications, and embodiments within the scope thereof, and additional fields in which the lighting systems described herein would be of significant utility.

The following detailed description is merely exemplary in nature and is not intended to limit the applications and uses disclosed herein. Further, there is no intention to be bound by any theory presented in the preceding background or summary or the following detailed description.

The embodiments address concerns associated with mounting a downlight lighting fixture into a recess, carveout, or opening in a ceiling or other substantially flat surface or sub-surface. The ceiling may be associated with an office, a retail location, or similar environment.

Figure 1A:
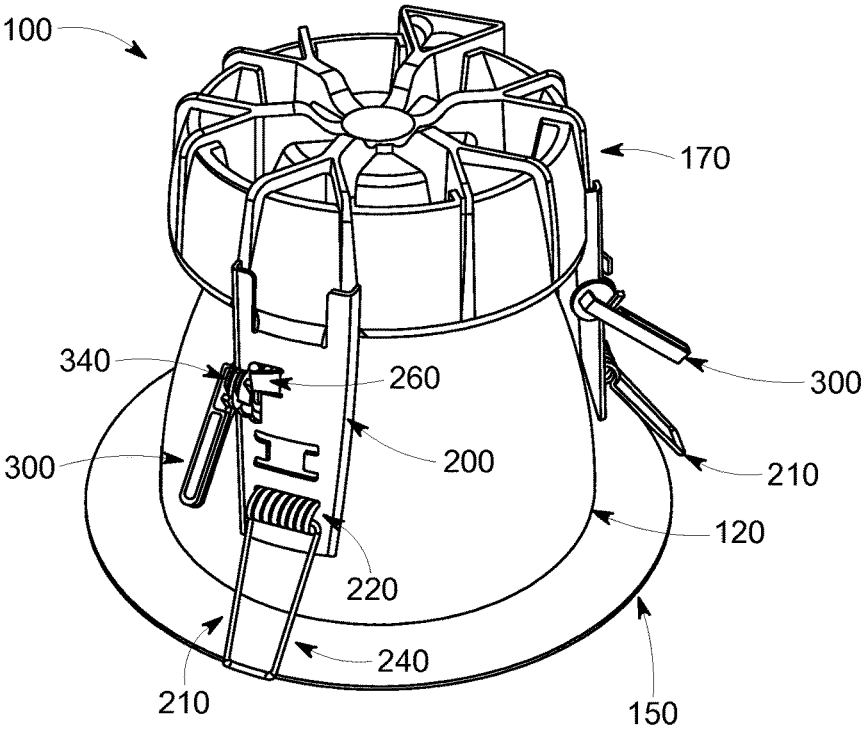
FIG. 1A depicts a lighting fixture mounted using a bracket with a lever retainer in a disengaged position in accordance with an exemplary embodiment of the present invention.

FIG. 1A depicts a lighting fixture 100 mounted using a bracket with a lever retainer in a disengaged position in accordance with an exemplary embodiment of the present invention. The lighting fixture 100 includes (i) a housing 120 enclosing electronics, such as an infusion module, (ii) a lens 150, optical or otherwise, configured for emitting, diffusing, or otherwise passing light emitted by lights (e.g., LEDs), and (iii) a heat sink 170 to provide cooling for optics and other embedded electronics within the housing 120.

The lighting fixture 100 further includes a bracket 200 attached or otherwise affixed to a portion of the lighting fixture 100, such as the heat sink 170. The bracket 200 is configured to stabilize the positioning of the lighting fixture 100 when installed within into an opening 110 (depicted in FIG. 2A). The bracket 200 additionally includes a tension mechanism, such as a spring clamp 210 having a spring coil 220 and a spring arm 240.

In a minimal tension position, the spring coil 220 has a preset amount of tension within its coil windings. During installation of the lighting fixture 100, the spring arm 240 is moved from the minimal tension position to a maximum tension position that produces additional tension greater than the preset tension in the spring coil 220. For example, the spring arm 240 is raised from the minimal position illustrated in FIG. 1A to the maximum tension position illustrated in FIG. 1B, which creates additional tension in the spring coil 220.

The embodiments of the present invention are not limited to the spring clamp 210. Other suitable configurations are available, such as but not limited to machined springs and flat springs, as understood by those of skill in the art, and would be within the spirit and scope of the present invention.

The lighting fixture 100 includes an additional engagement mechanism, such as a lever retainer 300 and/or a sheet retainer 400 (depicted in FIG. 3A) constructed in accordance with embodiments of the present invention. The engagement mechanisms can be independent from or in conjunction with the bracket 200.

The engagement mechanisms simplify installation of the lighting fixture 100 by eliminating the need for a user to holding springs, or mounting clamps, under tension while inserting the lighting fixture 100 through the opening 110. Specifically, the engagement mechanisms are configured to temporarily position and secure the spring clamp 210 in the maximum tension position prior to installation of the lighting fixture 100. In this manner, the risk of injury to an installer is substantially reduced. Additionally, risk of injury to the installer is reduced due to the deployment of the engagement mechanisms when contact is made with the ceiling 102, rather than having the engagement mechanisms that must be deployed by the user as in conventional approaches.

In some embodiments, one or more engagement mechanisms are in the form of the lever retainer 300. The lever retainer 300 is configured to position and secure the spring clamp 210 in the maximum tension position for a period of time prior to installation of the lighting fixture 100.

The lever retainer 300 may be one or more materials configured to sustain the spring arm 240 when the spring coil 220 is placed under additional tension, placing the spring clamp in the maximum tension position.

For example, the lever retainer 300 is one or more of plastics, metals, or any composites thereof. The lever retainer 300 may be formed and affixed to the bracket 200 using conventional techniques. For example, the lever retainer 300 is an injection molded component affixed or otherwise attached to the bracket in a post manufacturing process.

The lever retainer 300 is rotatable about a pivot point 340 that allows movement of the lever retainer 300 from a disengaged position prior to installation to an engaged position for installation and finally back to the disengaged position after installation. When the spring clamp 210 is in the minimal tension position, the lever retainer 300 is in a disengaged position that is not perpendicular to the spring clamp 210.

Figure 1B:
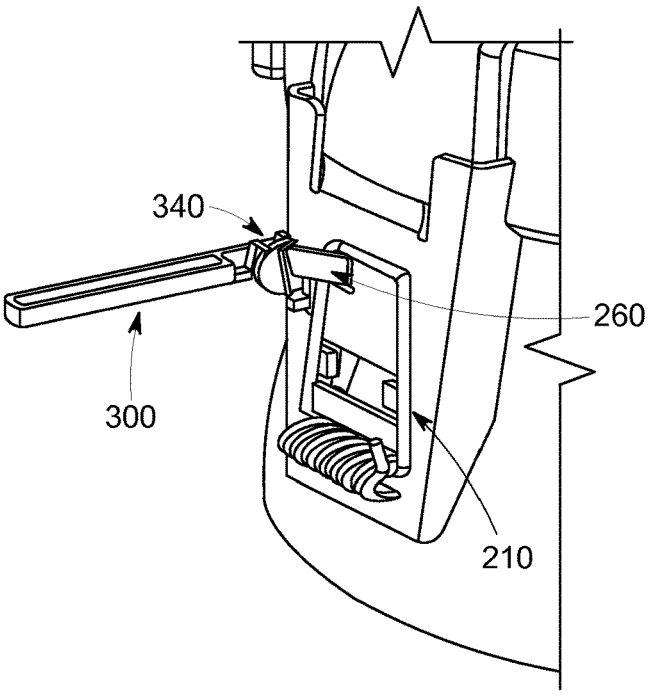
FIG. 1B depicts the bracket of FIG. 1A with the lever retainer in an engaged position.

The disengaged position can be any position where the lever retainer 300 forms an angle that is between perpendicular and parallel to the spring clamp 210. When the spring clamp 210 is in the maximum tension position, as illustrated by FIG. 1B, the lever retainer 300 is in an engaged position generally perpendicular to the spring clamp 210. Once the spring clamp 210 is released after installation, as described in association with FIGS. 2A-2C, the lever returns to the disengaged position that is not perpendicular.

In the embodiments, engagement of the spring clamp 210 occurs using a flange 260. The flange 260 is configured to retain the spring arm 240, which places the spring clamp 210 in the maximum tension position. The spring arm 240 is secured within the flange 260 by rotating the lever retainer 300 about the pivot point 340 such that the lever retainer 300 moves from the disengaged position (not perpendicular to clamp spring) to the engaged position (perpendicular to clamp spring). Thus, the final configuration prior to installation of the lighting fixture 100 is the spring clamp 210 being in the maximum tension position and the lever retainer 300 being in the engaged position.

Figure 2A:
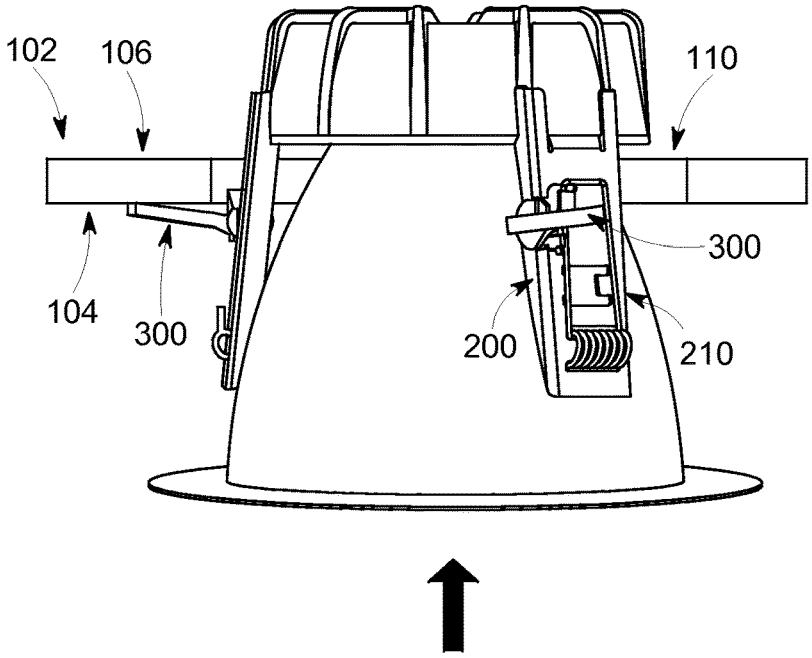
FIG. 2A-2C depicts a method of installing the lighting fixture in the engaged position of FIG. 1B into a ceiling.
Figure 2B:
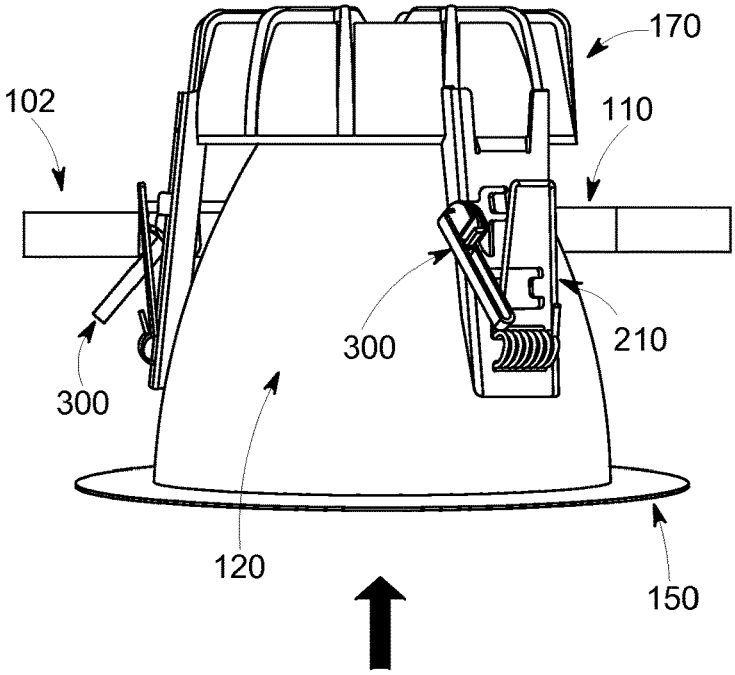
Figure 2C:
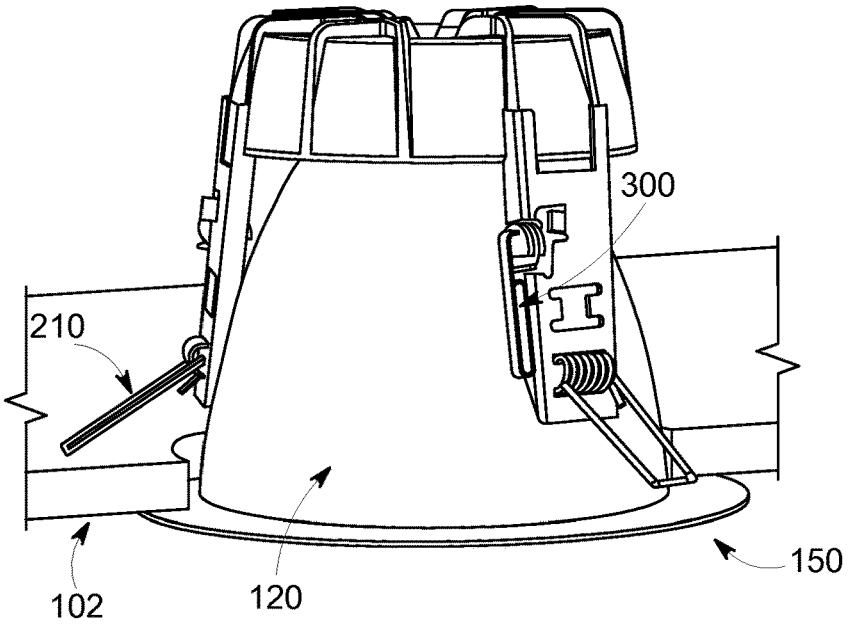

FIGS. 2A-2C illustrate exemplary stages occurring during installation of the lighting fixture 100 through the opening 110 using the lever retainer 300.

In FIG. 2A, the lighting fixture 100 is positioned to be received by the opening 110 of the ceiling 102 in a direction depicted as an arrow. Specifically, the heat sink 170 and the housing 120 are positioned to pass through the opening 110.

To pass through the opening 110, the lighting fixture 100 has each spring clamp 210 in the maximum tension position, as illustrated by FIG. 1B.

As stated above, when the spring clamp 210 is in the maximum tension position, the lever retainer 300 is in the engaged position generally perpendicular to the spring clamp 210. With the spring clamp 210 in the maximum tension position and the lever retainer 300 in the engaged position, the lever retainer 300 is configured to come in contact or otherwise engage a first side 104 of the ceiling 102.

In FIG. 2B, the housing 120 continues to pass through the opening 110 of the ceiling 102. As the lighting fixture 100 moves through the opening 110, the lever retainer 300 is pushed down by the first side 104 of the ceiling 102 to allow passage of the lighting fixture 100 through the opening 110.

As illustrated in FIG. 2C, when the lever retainer 300 is pushed down, the spring clamp 210 is released from the maximum tension position and allowed to return to the minimum tension position. The lever retainer 300 may remain in its disengaged position (e.g., positioned downward) once the spring clamp 210 is released. After the spring clamp 210 is released, the spring arm 240 is positioned in contact with a second side 106 of the ceiling 102. In the installed position for the lighting fixture 100, the housing 120 has passed through the opening 110 and the lens 150 is positioned in contact or nearly in contact with the first side 104 of the ceiling 102.

In other embodiments, one or more engagement mechanisms are in the form of the sheet retainer 400. Similar to the lever retainer 300, the sheet retainer 400 is configured to position and secure the spring clamp 210 in the maximum tension position for a period of time prior to installation of the lighting fixture 100.

The sheet retainer 400 is affixed to the bracket 200 at a position above the spring clamp 210 and is movable about the affixed position. In some embodiments, the sheet retainer 400 is a substantially flat piece of material used to retain the spring clamp 210. The sheet retainer 400 may be formed and affixed to the bracket 200 using conventional techniques.

Figure 3A:
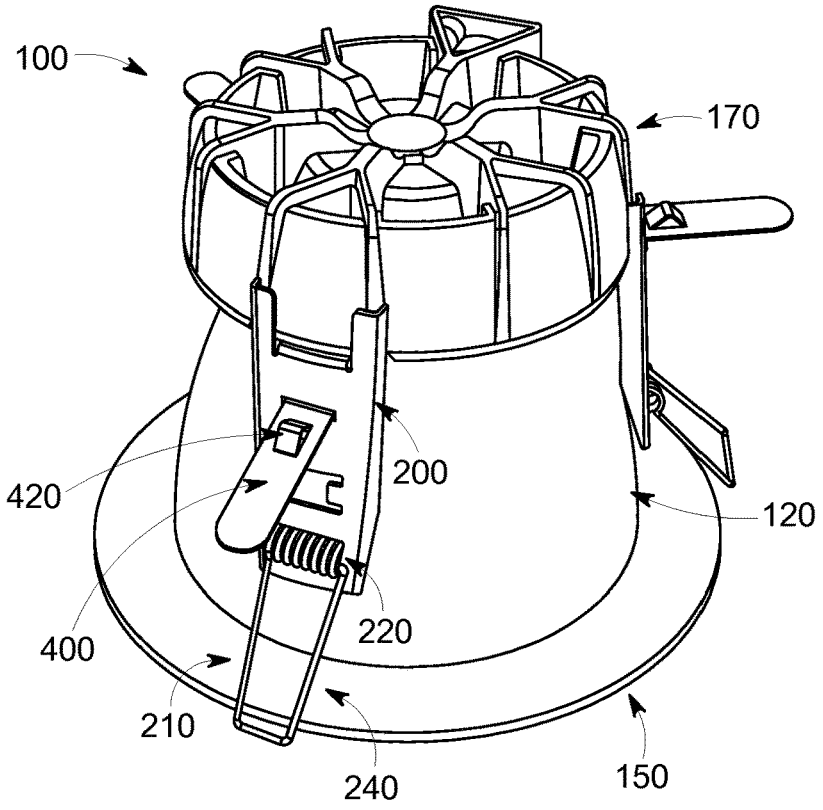
FIG. 3A depicts a lighting fixture mounted a bracket with a sheet retainer in a disengaged position in accordance with a second exemplary embodiment.

When the sheet retainer 400 is in a first (disengaged) position, the spring clamp 210 is in the minimal tension position as illustrated by FIG. 3A. In a second (engaged) position, the spring clamp 210 is in the maximum tension position, as illustrated by FIG. 3B.

Figure 3B:
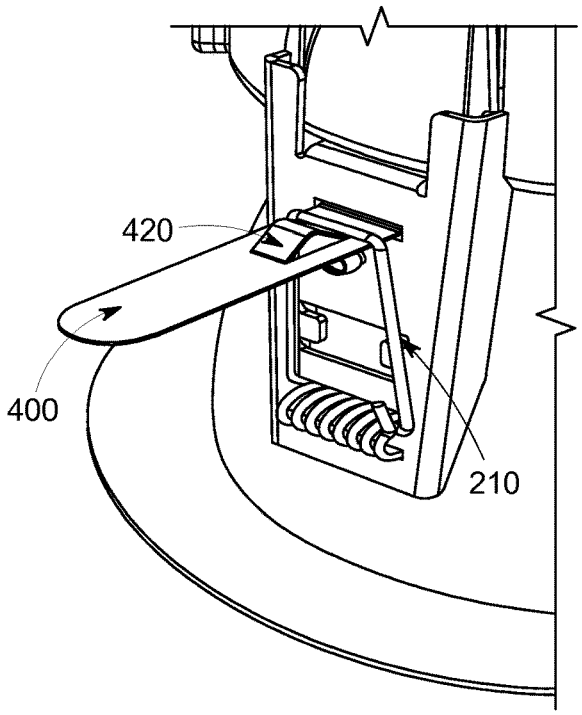
FIG. 3B depicts the bracket of FIG. 3A with the sheet retainer in an engaged position.

In some embodiments, the spring clamp 210 is placed under maximum tension by temporarily securing the spring arm 240 using a lance 420 or securing means, as depicted in FIG. 3B. The lance 420 may be formed on or subsequently added to the sheet retainer 400. For example, the lance 420 may be formed using a metal forming (e.g., stamping and punching) operation. Alternatively, the lance 420 may be added to the sheet retainer 400 in a post manufacturing operation. Where the lance 420 is used, the spring arm 240 is positioned behind the lance 420, thus positioning the spring clamp 210 in the maximum tension position to allow passage of the housing 120 through the opening 110 of the ceiling 102.

The sheet retainer 400 can be composed of one or more materials configured to sustain the spring arm 240 when the spring coil 220 is placed in the maximum tension position. For example, the sheet retainer 400 is one or more of plastics, metals, or any composites thereof.

In the embodiments, the sheet retainer 400 can be composed of a rigid material that allows deformation of the sheet retainer 400 in one direction (e.g., a direction of force application). Specifically, the sheet retainer 400 moves from the first (engaged) position to the second (disengaged) position to allow release the spring clamp 210 and remains in the second position upon release of the spring clamp 210.

In other embodiments, the sheet retainer 400 is composed of flexible materials that allow the sheet retainer 400 to move from the first (engaged) position to the second (disengaged) position and back to the first position. For example, the sheet retainer 400 bends from the first position to the second position to allow release the spring clamp 210 and then returns to the first position upon release of the spring clamp 210, as illustrated in FIGS. 4A-4C.

Figure 4A:
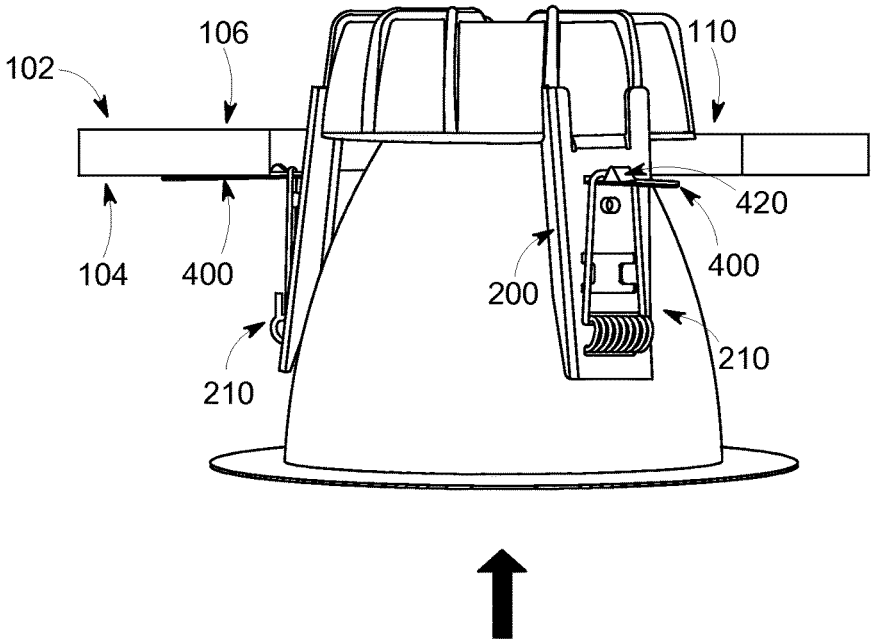
FIG. 4A-4C depicts a method of installing the lighting fixture in the engaged position of FIG. 3B into a ceiling.
Figure 4B:
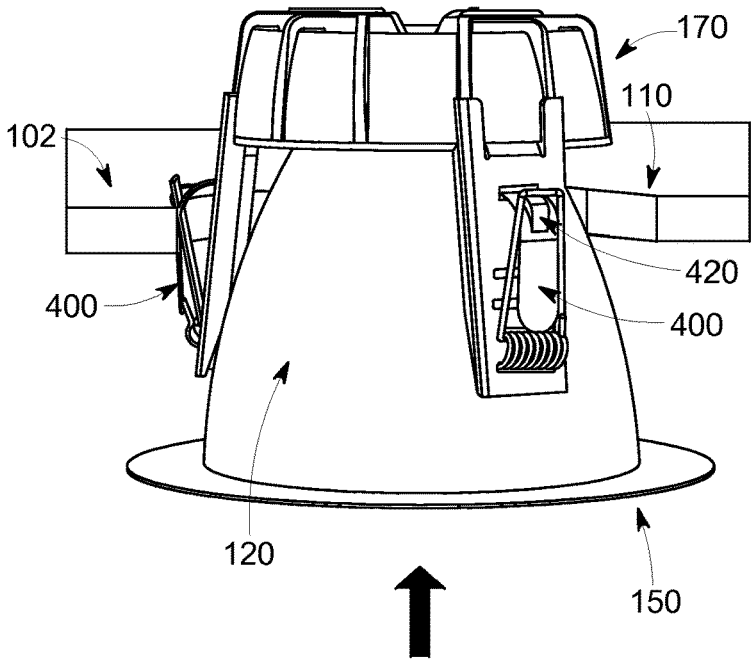
Figure 4C:
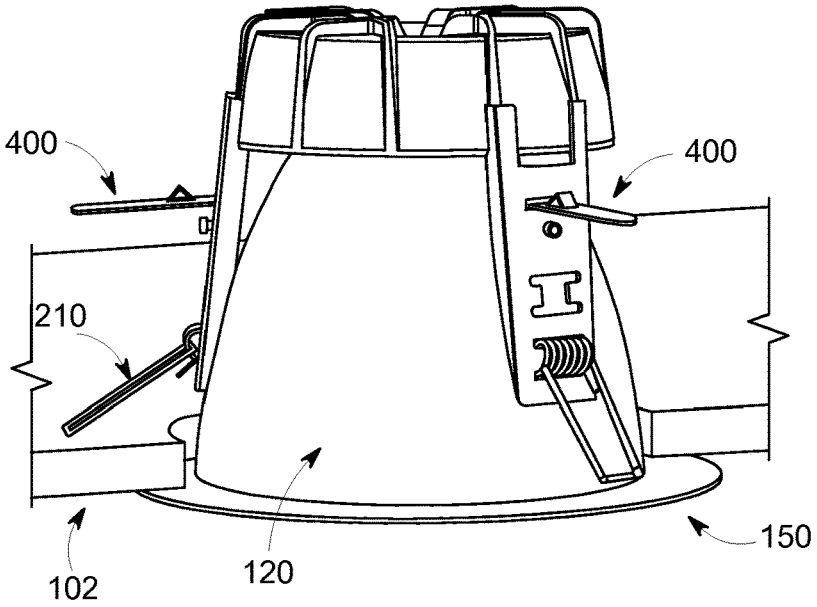

FIGS. 4A-4C illustrate exemplary stages occurring during installation of the lighting fixture 100 through the opening 110 using the sheet retainer 400.

In FIG. 4A, the lighting fixture 100 is positioned to be received by the opening 110 of the ceiling 102 in a direction depicted as an arrow. To pass through the opening 110, the lighting fixture 100 has each spring clamp 210 in the maximum tension position, as illustrated by FIG. 3B. With the spring clamp 210 in the maximum tension position, the sheet retainer 400 is configured to come in contact or otherwise engage the first side 104 of the ceiling 102.

In FIG. 4B, as the housing 120 moves through the opening 110, the sheet retainer 400 is pushed down by the first side 104 of the ceiling 102 to allow passage of the lighting fixture 100 through the opening 110. During passage through the opening 110, contact of the sheet retainer 400 with the first side 104 allows the spring clamp 210 to move from a position behind to a position in front of the lance 420. Specifically, the spring arm 240 moves over the lance 420. When the sheet retainer 400 is pushed down by the first side 104, the spring clamp 210 is released from the maximum tension position and allowed to return to the minimum tension position.

Once the housing 120 has passed through the opening, the sheet retainer 400 may remain in the second (disengaged) position once the spring clamp 210 is released or return to the first (engaged) position for future usage, as illustrated in FIG. 4C. After the spring clamp 210 is released, the spring arm 240 is positioned in contact with the second side 106 of the ceiling 102. In the installed position for the lighting fixture 100, the housing 120 has passed through the opening 110 and the lens 150 is positioned in contact or nearly in contact with the first side 104 of the ceiling 102.

CONCLUSION

Those skilled in the art, particularly in light of the foregoing teachings, may make alternative embodiments, examples, and modifications that would still be encompassed by the technology. Further, it should be understood that the terminology used to describe the technology is intended to be in the nature of words of description rather than of limitation.

Those skilled in the art will also appreciate that various adaptations and modifications of the preferred and alternative embodiments described above can be configured without departing from the scope and spirit of the technology. Therefore, it is to be understood that, within the scope of the appended claims, the invention may be practiced other than as specifically described herein.

What we claim is:

1. A device, comprising:

an engagement mechanism comprising a lever retainer configured for mounting a lighting fixture within a recess of a substantially flat surface having first and second sides;

wherein the lever retainer is rotated about a pivot point along a first direction to move a flange coupled to a bracket along a second direction different from the first direction to secure at least a portion of a tension mechanism of the lighting fixture to the flange, wherein the tension mechanism is positioned at a maximum tension position when at least the portion of the tension mechanism is secured to the flange; and wherein the lever retainer is configured to facilitate movement of the tension mechanism from the maximum tension position to a minimum tension position, the movement being responsive to an applied force on the lever retainer by contact with the first side such that the tension mechanism is in contact with the second side.

2. The device of claim 1, wherein the substantially flat surface includes at least one from the group including a ceiling and a wall.

3. The device of claim 2, wherein the recess is a carveout area in the ceiling.

4. The device of claim 1, wherein the tension mechanism includes at least one from the group including a spring clamp, a machined spring, and a flat spring.

5. The device of claim 1, wherein the lever retainer is configured to release the tension mechanism upon contact with the first side.

6. The device of claim 5, wherein the lever retainer is rotated upon contact with the first side to cause the flange to release at least the portion of the tension mechanism.

7. A device for mounting a lighting fixture within a recess of a substantially flat surface, comprising:

a bracket configured for attachment to the lighting fixture having a tension mechanism; and an engagement mechanism comprising a lever retainer configured for mounting the lighting fixture within a recess of the substantially flat surface having first and second sides;

wherein the lever retainer is rotated about a pivot point along a first direction to move a flange coupled to the bracket along a second direction different from the first direction to secure at least a portion of the tension mechanism of the lighting fixture to the flange, wherein the tension mechanism is positioned at a maximum tension position when at least the portion of the tension mechanism is secured to the flange; and wherein the lever retainer is configured to facilitate movement of the tension mechanism from the maximum tension position to a minimum tension position, the movement being responsive to the applied force on the lever retainer by contact with the first side of the substantially flat surface such that the tension mechanism is in contact with the second side.

8. The device of claim 7, wherein the substantially flat surface includes at least one from the group including a ceiling and a wall.

9. The device of claim 8, wherein the recess is a carveout area in the ceiling.

10. The device of claim 7, wherein the tension mechanism includes at least one from the group including a spring clamp, a machined spring, and a flat spring.

11. The device of claim 7, wherein the lever retainer is configured to release the tension mechanism upon contact with the first side.

12. The device of claim 11, wherein the lever retainer is rotated upon contact with the first side to cause the flange to release at least the portion of the tension mechanism.

13. A method for mounting a lighting fixture comprising:

rotating a lever retainer of an engagement mechanism about a pivot point along a first direction to move a flange coupled to a bracket along a second direction different from the first direction to secure a spring clamp of the lighting fixture to the flange when the spring clamp is moved from a minimum tension position to a maximum tension position;

positioning the lighting fixture with the spring clamp in the maximum tension position proximal to a recess of a substantially flat surface having first and second sides; and moving the lighting fixture through the recess, the first side applying a force on the lever retainer causing the spring clamp to move from the maximum tension position back to approximately the minimum tension position, such that the spring clamp is in contact with the second side.

14. The method of claim 13, wherein the lever retainer is configured to release the spring clamp upon contact with the first side.

* * * * *